US010355356B2

(12) United States Patent
Casse et al.

(10) Patent No.: US 10,355,356 B2
(45) **Date of Patent: *Jul. 16, 2019**

(54) METAMATERIAL-BASED PHASE SHIFTING ELEMENT AND PHASED ARRAY

(71) Applicant: Palo Alto Research Center Incorporated, Palo Alto, CA (US)

(72) Inventors: Bernard D. Casse, Saratoga, CA (US); Armin R. Volkel, Mountain View, CA (US); Victor Liu, Mountain View, CA (US); Alexander S. Tuganov, Redwood City, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 7 days.

This patent is subject to a terminal disclaimer.

(21) Appl. No.: 15/849,428

(22) Filed: Dec. 20, 2017

(65) Prior Publication Data

US 2018/0138570 A1 May 17, 2018

Related U.S. Application Data

(63) Continuation-in-part of application No. 14/330,977, filed on Jul. 14, 2014, now Pat. No. 9,972,877.

(51) Int. Cl.
*H01Q 3/36* (2006.01)
*H01P 1/18* (2006.01)
(Continued)

(52) U.S. Cl.
CPC ..... *H01Q 3/36* (2013.01); *H01P 1/184* (2013.01); *H01Q 3/46* (2013.01);
(Continued)

(58) Field of Classification Search
CPC ..... H01P 1/184; H03F 1/345; G01R 27/28; G01N 22/00; H01Q 3/36; H01Q 3/46;
(Continued)

(56) References Cited

U.S. PATENT DOCUMENTS 3,929,594 A 12/1975 Fromson
4,065,364 A 12/1977 Fromson
(Continued)

FOREIGN PATENT DOCUMENTS

CN 102778144 11/2012
CN 103312042 A 9/2013
(Continued)

OTHER PUBLICATIONS

Pratap et al., "Plasmonic Properties of Gold-Coated Nanoporous Anodic Alumina With Linearly Organized Pores," Pramana—J. Phys. (Dec. 2014), vol. 83, No. 6, pp. 1025-1033.
(Continued)

*Primary Examiner* — Benny T Lee
*Assistant Examiner* — Hafizur Rahman
(74) *Attorney, Agent, or Firm* — Bever, Hoffman & Harms, LLP

(57) ABSTRACT

A metamaterial-based phase shifting element utilizes a variable capacitor (varicap) to control the effective capacitance of a metamaterial structure in order to control the phase of a radio frequency output signal generated by the metamaterial structure. The metamaterial structure is configured to resonate at the same radio wave frequency as an incident input signal (radiation), whereby the metamaterial structure emits the output signal by way of controlled scattering the input signal. A variable capacitance applied on metamaterial structure by the varicap is adjustable by way of a control voltage, whereby the output phase is adjusted by way of adjusting the control voltage. The metamaterial structure is constructed using inexpensive metal film or PCB fabrication technology including an upper metal "island" structure, a lower metal backplane layer, and a dielectric layer sandwiched therebetween. The varicap is connected between the
(Continued)

island structure and a base metal structure that surrounds the island structure.

20 Claims, 8 Drawing Sheets

(51) Int. Cl.

| | |
|---|---|
| ***H01Q 21/06*** | (2006.01) |
| ***H01Q 3/46*** | (2006.01) |
| ***H01Q 21/08*** | (2006.01) |
| ***H01Q 15/00*** | (2006.01) |
| *H01Q 19/10* | (2006.01) |

(52) U.S. Cl.
CPC ..... *H01Q 15/0066* (2013.01); *H01Q 21/065* (2013.01); *H01Q 21/08* (2013.01); *H01Q 19/104* (2013.01)

(58) Field of Classification Search
CPC .. H01Q 15/0066; H01Q 21/065; H01Q 21/08; H01Q 19/104
USPC .... 333/25, 26, 109, 112, 116, 161; 330/175; 324/615, 637, 638, 642, 650
See application file for complete search history.

(56) References Cited

U.S. PATENT DOCUMENTS

| | | | |
|---|---|---|---|
| 4,315,873 | A | 2/1982 | Smith et al. |
| 4,361,630 | A | 11/1982 | Johnson, Sr. |
| 4,779,000 | A | 10/1988 | Ing |
| 5,043,739 | A | 8/1991 | Logan et al. |
| 5,712,166 | A | 1/1998 | Broan |
| 5,905,263 | A | 5/1999 | Nishizawa |
| 6,828,675 | B2 | 12/2004 | Memory |
| 7,002,517 | B2 | 2/2006 | Noujeim |
| 7,761,053 | B2 | 7/2010 | Kruzelecky |
| 8,621,245 | B2 | 12/2013 | Shearer et al. |
| 8,680,945 | B1 | 3/2014 | Wang |
| 8,908,253 | B2 | 12/2014 | Hendaoui |
| 2002/0180639 | A1 | 12/2002 | Rockett et al. |
| 2004/0207486 | A1 | 10/2004 | York |
| 2004/0238751 | A1 | 12/2004 | Penn |
| 2005/0178533 | A1 | 8/2005 | Minamitani |
| 2006/0234505 | A1 | 10/2006 | Asano et al. |
| 2008/0049228 | A1 | 2/2008 | Chan |
| 2009/0207000 | A1 | 8/2009 | Mickle et al. |
| 2009/0220802 | A1 | 9/2009 | Faber et al. |
| 2009/0284351 | A1 | 11/2009 | Rossman et al. |
| 2011/0303850 | A1 | 12/2011 | Barillon |
| 2011/0309686 | A1 | 12/2011 | Scherbenski et al. |
| 2012/0133547 | A1 | 5/2012 | MacDonald et al. |
| 2012/0314541 | A1 | 12/2012 | Matsuura |
| 2013/0076570 | A1 | 3/2013 | Lee et al. |
| 2013/0187830 | A1 | 7/2013 | Warnick et al. |
| 2014/0110263 | A1 | 4/2014 | Barbier |
| 2014/0131023 | A1 | 5/2014 | Raman et al. |
| 2014/0266946 | A1 | 9/2014 | Billy et al. |
| 2014/0300520 | A1 | 10/2014 | Nguyen et al. |
| 2014/0355381 | A1 | 12/2014 | Lai et al. |
| 2015/0056404 | A1 | 2/2015 | Sawafta |
| 2015/0214927 | A1 | 7/2015 | Greene et al. |
| 2015/0229028 | A1 | 8/2015 | Billy et al. |
| 2015/0236551 | A1 | 8/2015 | Shearer et al. |
| 2015/0276489 | A1 | 10/2015 | Cumming |
| 2015/0318618 | A1 | 11/2015 | Chen et al. |
| 2015/0372389 | A1 | 12/2015 | Chen et al. |
| 2015/0380973 | A1 | 12/2015 | Scheb |
| 2016/0145214 | A1 | 5/2016 | Douce |
| 2016/0181867 | A1 | 6/2016 | Daniel et al. |
| 2016/0254844 | A1 | 9/2016 | Hull et al. |
| 2016/0336198 | A1 | 11/2016 | Singleton et al. |
| 2016/0359378 | A1 | 12/2016 | Kuhn et al. |
| 2017/0234168 | A1 | 8/2017 | Scholz |

FOREIGN PATENT DOCUMENTS

| | | |
|---|---|---|
| WO | 200143228 A | 6/2001 |
| WO | 2007015281 | 2/2007 |
| WO | 2013039926 | 3/2013 |
| WO | 2015038203 | 3/2015 |

OTHER PUBLICATIONS

Noh et al., Highly Self-Assembled Nanotubular Aluminum Oxide by Hard Anodization, (Jan. 29, 2011), J. Mater. Res., vol. 26, Issue 2, pp. 186-193.

Aoyama, Takahiko et al. "Energy response of a full-energy-absorption neutron spectrometer using boron-loaded liquid scintillator BC-523", Nuclear Instruments and Methods in Physics Research A 333 (1993) 492-501, 10 pages.

Flaska, Marek et al., "Digital pulse shape analysis for the capture-gated liquid scintillator BC-523A", Nuclear Instruments and Methods in Physics Research A 599 (2009) 221-225, 5 pages.

Vanier, Peter E., et al., "Directional detection of fission-spectrum neutrons", 1-4244-1302-8/07, 2007 IEEE, 5 pages.

Vanier, Peter E., et al., "Calibration and Testing of a Large-Area Fast-Neutron Directional Detector", Brookhaven National Laboratory, BNL-79632-2007-CP, 8 pages.

Mascarenhas, Nicholas, et al., "Directional Neutron Detectors for Use with 14 MeV Neutrons", Sandia Report, SAND2005-6255, printed Oct. 2005, 32 pages.

Mirenda, Martin, et al., "Ionic liquids as solvents for liquid scintillation technology, Cerenkov counting with 1-Butyl-3-Methylimidazolium Chloride", Radiation Physics and Chemistry 98 (2014) 98-102, 5 pages.

Swiderski, L., et al., "Further Study of Boron-10 Loaded Liquid Scintillators for Detection of Fast and Thermal Neutrons", IEEE Transactions on Nuclear Science, vol. 57, No. 1, Feb. 2010, 6 pages.

Rephaeli et al., "Ultrabroadband Photonic Structures to Achieve High-Performance Daytime Radiative Cooling," Nano Lett. (2013), vol. 13, pp. 1457-1461. (Year: 2013).

Hua et al., "Efficient Photon Management with Nanostructures for Photovoltaics," Nanoscale (2013), vol. 5, pp. 6627-6640. (Year: 2013).

Juan Li et al., "Facile Method for Modulating the Profiles and Periods of Self-Ordered Three-Dimensional Alumina Taper-Nanopores," ACS Appl. Mater. Interfaces 2012, 4, 5678-5683.

Juan Li et al., "Tailoring Hexagonally Packed Metal Hollow-Nanocones and Taper-Nanotubes by Template-Induced Preferential Electrodeposition," ACS Appl. Mater. Interfaces 2013, 5, 10376-10380.

METAMATERIAL-BASED PHASE SHIFTING ELEMENT AND PHASED ARRAY

RELATED APPLICATIONS

This application is a continuation of U.S. patent application Ser. No. 14/330,977, entitled "Metamaterial-Based Phase Shifting Element And Phased Array", filed Jul. 14, 2014, now issued as U.S. Pat. No. 9,972,877.

FIELD OF THE INVENTION

This invention relates to phase shifting elements and methods for shifting the phase of emitted radiant energy.

BACKGROUND OF THE INVENTION

Phase shifters are two-port network devices that provide a controllable phase shift (i.e., a change the transmission phase angle) of a radio frequency (RF) signal in response to control signal (e.g., a DC bias voltage). Conventional phase shifters can be generally classified as ferrite (ferroelectric) phase shifters, integrated circuit (IC) phase shifters, and microelectromechanical system (MEMS) phase shifters. Ferrite phase shifters are known for low insertion loss and their ability to handle significantly higher powers than IC and MEMS phase shifters, but are complex in nature and have a high fabrication cost. IC phase shifters (aka, microwave integrated circuit MMIC) phase shifters) use PIN diodes or FET devices, and are less expensive and smaller in size than ferrite phase shifters, but their uses are limited because of high insertion loss. MEMS phase shifters use MEMS bridges and thin-film ferroelectric materials to overcome the limitations of ferrite and IC phase shifters, but still remain relatively bulky, expensive and power hungry.

While the applications of phase shifters are numerous, perhaps the most important application is within a phased array antenna system (a.k.a., phased array or electrically steerable array), in which the phase of a large number of radiating elements are controlled such that the combined electromagnetic wave is reinforced in a desired direction and suppressed in undesired directions, thereby generating a "beam" of RF energy that is emitted at the desired angle from the array. By varying the relative phases of the respective signals feeding the antennas, the emitted beam can be caused to scan or "sweep" an area or region into which the beam is directed. Such scan beams are utilized, for example, in phased array radar systems to sweep areas of interest (target fields), where a receiver is used to detect beam energy portions that are reflected (scattered) from objects located in the target field.

Because a large number of phase shifters are typically needed to implement a phased array (e.g., radar) system, the use of conventional phase shifters presents several problems for phased array systems. First, the high cost of conventional phase shifters makes phased array systems too expensive for many applications that might otherwise find it useful—it has been estimated that almost half of the cost of a phased array system is due to the cost of phase shifters. Second, the high power consumption of conventional phase shifters precludes mounting phased array systems on many portable devices that rely on battery power. Third, phased array systems that implement conventional phase shifters are typically highly complex due to the complex integration of many expensive solid-state, MEMS or ferrite-based phase shifters, control lines, together with power distribution networks, as well as the complexity of the phase shifters. Moreover, phased array systems implementing conventional phase shifters are typically very heavy, which is due in large part to the combined weight of the conventional phase shifters), which limits the types of applications in which phased arrays may be used. For example, although commercial airliners and medium sized aircraft have sufficient power to lift a heavy radar system, smaller aircraft and drones typically do not.

What is needed is a phase shifting element that avoids the high weight (bulk), high expense, complexity and high power consumption of conventional phase shifters. What is also needed is a phase shifting apparatus that facilitates the transmission of phase-shifted RF signals, and phased arrays that facilitate the transmission of steerable beams generated by phase-shifted RF signals using such phase shifting elements.

SUMMARY OF THE INVENTION

The present invention is directed to a metamaterial-based phase shifting element that utilizes a metamaterial structure to produce an output signal having the same radio wave frequency (i.e., in the range of 3 kHz to 300 GHz) as that of an applied/received input signal, and utilizes a varicap (variable capacitor) to control a phase of the output signal by way of an applied phase control signal. The metamaterial structure is constructed using inexpensive metal film or PCB fabrication technology having an inherent "fixed" capacitance, and is tailored by solving Maxwell's equations to resonate at the radio frequency of the applied input signal, whereby the metamaterial structure generates the output signal at the input signal frequency by retransmitting (i.e., reflecting/scattering) the input signal. According to an aspect of the invention, the varicap is coupled to the metamaterial structure such that an effective capacitance of the metamaterial structure is determined as a product of the metamaterial structure's inherent (fixed) capacitance and the variable capacitance supplied by the varicap. The phase of the output signal is thus "tunable" (adjustably controllable) to a desired phase value by way of changing the variable capacitance applied to the metamaterial structure, and is achieved by way of changing the phase control signal (e.g., a DC bias voltage) applied to the varicap. By combining the metamaterial structure described above with an appropriate varicap, the present invention provides a phase shifter element that is substantially smaller/lighter, less expensive, and consumes far less power than conventional phase-shifting elements. Further, because the metamaterial structure and varicap generate a radio wave frequency output signal without the need for a separate antenna feed, the present invention facilitates the production of greatly improved phase-shifting apparatus and phased array systems in comparison to those produced using conventional phase shifters.

In accordance with an embodiment of the present invention, a phase shifting element utilizes a two-terminal varicap having a first terminal connected to the metamaterial structure and a second terminal disposed for connection to a fixed DC voltage source (e.g., ground), and the phase control signal is applied by way of a conductive structure that is connected either to the metamaterial structure or directly to the first terminal of the varicap. With this arrangement, operation of the varicap is easily controlled by applying the phase control signal (i.e., a bias voltage) to the conductive structure, thereby causing the varicap to generate a variable capacitance having a capacitance level determined by (e.g., proportional to) the applied phase control signal. In a preferred embodiment, the conductive structure contacts the variable capacitor terminal to minimize signal loss that might occur if applied to the metamaterial structure. This arrangement also facilitates accurate simultaneous control over multiple metamaterial-based phase shifting elements by facilitating connection of the second variable capacitor terminal to a fixed (e.g., ground) potential.

In accordance with a practical embodiment of the present invention, the metamaterial structure includes a three-layer structure including an upper (first) patterned metal layer ("island") structure that is connected to the first terminal of the varicap, an electrically isolated (floating) second metal structure (backplane layer) disposed below the island structure, and dielectric layer sandwiched between the island and lower metal layer structures. The island and lower metal layer structures are cooperatively configured (e.g., sized, shaped and spaced) such that the composite metamaterial structure has a fixed capacitance and other attributes that facilitate resonance at the radio wave frequency of the input signal. In addition to utilizing low-cost fabrication techniques that contribute to the low cost of phase shifters produced in accordance with the present invention, the layered structure (i.e., upper metal layer "island" disposed over floating lower metal layer structure) acts as a wavefront shaper, which ensures that the output signal is highly-directional in the upward/outward direction only, and which minimizes power consumption because of efficient scattering with phase shift. In a presently preferred embodiment, the metamaterial structure utilizes a lossless dielectric material that mitigates absorption of the input signal (i.e., incident radiation), and ensures that most of the incident radiation is re-emitted in the output signal. In accordance with another feature, the island structure is co-disposed on an upper surface of the dielectric layer with a base (third) metal layer structure in a spaced-apart manner, with the varicap connected between the upper metal layer structure and the base metal structure. This practical arrangement further reduces manufacturing costs by facilitating attachment of the varicap using low-cost surface-mount technology. In a preferred embodiment, the base (grounded) metal layer covers almost the entire upper dielectric surface and defines an opening in which the island structure disposed such that the base metal layer is separated from the island structure by a peripheral gap having a uniform width. This base structure arrangement serves two purposes: first, by providing a suitable peripheral gap distance between the base metal layer and the island structure, the base metal layer effectively becomes part of the metamaterial structure (i.e., the fixed capacitance metamaterial structure is enhanced by a capacitance component generated between the base metal layer and the island structure); and second, by forming the base metal layer in a closely spaced proximity to island structure, the base metal layer serves as a scattering surface that supports collective mode oscillations, and ensures scattering of the output signal (wave) in the upward/forward direction. In accordance with another feature, both the base metal layer and the island structure are formed using a single (i.e., the same) metal (e.g., copper), thereby further reducing fabrication costs by allowing the formation of the base metal layer and the island structure using a low-cost fabrication processes (e.g., depositing a blanket metal layer, patterning, and then etching the metal layer to form the peripheral grooves/gaps). In accordance with another preferred embodiment, a metal via structure extends through an opening formed through the lower metal layer structure and the dielectric layer, and contacts the variable capacitor terminal. This arrangement facilitates applying phase control voltages across the variable capacitor without complicating the metamaterial structure shape, and also simplifies distributing multiple phase control signals to multiple phase shifters disposed in phased array structures including multiple phase shifting elements.

According to exemplary embodiments of the invention, each island (first metal layer) structure is formed as a planar square structure disposed inside a square opening defined in the base (third) metal layer. The square shape provides a simple geometric construction that is easily formed, and provides limited degrees of freedom that simplifies the mathematics needed to correlate phase control voltages with desired capacitance changes and associated phase shifts. However, unless otherwise specified in the claims, it is understood that the metamaterial structure can have any geometric shape (e.g., round, triangular, oblong). In some embodiments, the island (first metal layer) structure is formed as a patterned planar structure that defines (includes) one or more open regions (i.e., such that portions of the upper dielectric surface are exposed through the open regions). In one exemplary embodiment, the island structure includes a (square-shaped) peripheral frame portion, radial arms that extend inward from the frame portion, and an inner (e.g., X-shaped) structure that is connected to inner ends of the radial arms, where open regions are formed between portions of the inner structure and the peripheral frame. Although the patterned metamaterial structure may complicate the mathematics associated with correlating control voltage and phase shift values, the patterned approach introduces more degrees of freedom, leading to close to 360° phase swings, which in turn enables beam steering at large angles (i.e., greater than plus or minus 60°).

According to another embodiment of the present invention, a phase shifting apparatus includes at least one phase shifting element (as described above), and further includes a signal source (e.g., a feed horn or a leaky-wave feed) disposed in close proximity to the phase shifting element and configured to generate the input signal at a radio wave frequency that matches the resonance characteristics of the phase shifting element, and a control circuit (e.g., a digital-to-analog converter (DAC) that is controlled by any of a field programmable gate array (FPGA), an application specific integrated circuit (ASIC), or a micro-processor) that is configured to generate the phase control voltages applied to the varicap at voltage levels determined in accordance with (e.g., directly or indirectly proportional to) a pre-programmed signal generation scheme or an externally supplied phase control signal, whereby the metamaterial structure generates the output signal at a desired output phase. The metamaterial structure preferably includes the layered structure described above (i.e., an upper (first) metal layer "island" structure, an electrically isolated (floating) lower (backplane) metal layer structure, and an intervening dielectric layer) that is configured to resonate at the radio wave frequency of the input signal generated by the signal source, which is disposed above the island structure to facilitate emission of the output signal in a direction away from the island structure. As in the element embodiment, a base (third) metal layer structure is disposed on the upper dielectric surface in proximity to the island structure to facilitate a convenient ground connection for the varicap and to enhance the fixed capacitance of the metamaterial structure. In a specific embodiment, the control circuit is mounted below the backplane (second metal) layer (e.g., on a lower dielectric layer), and phase control voltages are passed from the control circuit to the varicap by way of a metal via that extends through the layered structure.

According to another embodiment of the present invention, a phased array system utilizes a phase shifting element array (as described above) to generate an emitted radio frequency energy beam, which is produced by combining a plurality of output signals having respective associated output phases that are determined e.g., by a beam directing control signal. The phase shifting element array includes multiple metamaterial structures and associated varicaps that are arranged in either a one-dimensional array, or in a two-dimensional array, a signal source positioned in the center of the array, and a control circuit. Each metamaterial structure generates an associated output signals having an output phase determined by a variable capacitance supplied by its associated varicap in the manner described above, and each varicap generates a variable capacitance in accordance with an associated phase control voltage received from the control circuit in a manner similar to that described above. In this case, the control circuit (e.g., a DAC controller mounted on a backside surface of the array) is configured to transmit a different phase control voltage to each of the varicaps such that the metamaterial structures (radiating elements) simultaneously generate output signals with output phases controlled such that the output signals cumulatively generate the emitted beam (i.e., the combined electromagnetic wave generated by the output signals is reinforced in a desired direction and suppressed in undesired directions, whereby the beam is emitted in the desired direction). When the metamaterial structures are arranged in a one-dimensional array (i.e., such that metal island structures of each metamaterial structure are aligned in a row), changes in the voltage levels of the phase control voltages produce "steering" of the emitted beam in a fan-shaped two-dimensional region disposed in front of the phase shifting element array. When the metamaterial structures are arranged in a two-dimensional array (e.g., such that the metal island structures are aligned in orthogonally arranged rows and columns), changes in the voltage levels of the phase control voltages produce "steering" of the emitted beam in a cone-shaped three-dimensional region disposed in front of the phase shifting element array.

According to various alternative specific embodiments, the phased array systems utilizes features similar to those described above with reference to individual phase shifters. For example, in a preferred embodiment the phase shifting element array includes a (e.g., lossless) dielectric layer disposed over a "shared" electrically isolated (floating) backplane layer structure, where each metamaterial structure includes an associated portion of the backplane layer disposed directly under the metal island structure (i.e., along with the dielectric layer portion sandwiched therebetween). This "shared" layered structure facilitates low cost array fabrication. The array also includes a shared base (grounded) metal layer structure disposed on the upper dielectric surface that is spaced (i.e., electrically isolated) from the island structures, thereby providing a convenient structure for operably mounting the multiple varicaps. The base metal layer structure is preferably concurrently formed with the metal island structures using a single metal deposition that is patterned to define narrow gaps surrounding the metal island structures, and to otherwise entirely cover the upper dielectric surface in order to provide a scattering surface that supports collective mode oscillations, and to ensure scattering of the wave in the forward direction. Metal traces and metal via structures are utilized to pass control voltages from the control circuit, which is mounted below the backplane layer structure, to the various variable capacitors. The metal island structures are alternatively formed as solid square or patterned metal structures for the beneficial reasons set forth above.

According to another alternative embodiment of the present invention, a method is provided controlling a radio frequency output signal such that an output phase of the radio frequency output signal has a desired phase value. The method includes causing a metamaterial structure to resonate at the input signal's radio wave frequency such that the metamaterial structure generates the output signal, applying a variable capacitance onto to the metamaterial structure such that an effective capacitance of the metamaterial structure is altered by the applied variable capacitance, and then adjusting the variable capacitance until the metamaterial structure generates the radio frequency output signal with the output phase having the desired phase value. Causing the metamaterial structure to resonate at the input signal's radio wave frequency is accomplished, for example, by generating the input signal a radio frequency equal to resonance characteristics of the metamaterial structure, and directing the input signal on to the metamaterial structure. Applying the variable capacitance onto to the metamaterial structure is accomplished, for example, by applying a phase control voltage to a varicap connected to the metamaterial structure, and adjusting phase control voltage Vc, thereby changing (altering) the effective capacitance of the metamaterial structure and causing the metamaterial structure to generate the output signal at the desired output phase determined by the applied phase control voltage.

According to another alternative embodiment, a phase shifting method is provided for generating an output signal having an output phase determined by a phase control voltage such that a change in the phase control signal result in phase changes in the output signal by a predetermined amount. The method includes generating an input signal having a radio frequency that causes a metamaterial structure to resonate at the radio frequency, thereby causing the metamaterial structure to retransmit the signal (i.e., to generate an output signal having frequency equal to that of the input signal). The method further involves applying the phase control voltage to a varicap that is coupled to the metamaterial structure such that an effective capacitance of the metamaterial structure is altered by a corresponding change in a variable capacitance generated by the varicap in response to the applied phase control voltage. The resulting change in effective capacitance of the metamaterial structure produces a phase shift in the output signal by an amount proportional to the applied phase control voltage.

According to another alternative embodiment, a method is provided for controlling the direction of an emitted beam without using conventional phase shifters and external antennae. The method includes generating an input signal having a radio frequency that causes multiple metamaterial structures disposed in an array to resonate at the radio frequency, thereby causing each of the metamaterial structures to retransmit the signal (i.e., each metamaterial structure generates an associated output signal at the radio frequency). The method further includes applying variable capacitances to each of the metamaterial structures such that an effective capacitance of each metamaterial structure is altered by a corresponding change in its associated applied variable capacitance, whereby each the metamaterial structure generates its output signal at a corresponding output phase determined by the applied associated variable capacitance. To achieve control over the beam direction, an associated pattern of different variable capacitances are applied to the metamaterial structures (radiating elements), whereby the resulting effective capacitances produce output signals with output phases controlled such that the output signals cumulatively generate the emitted beam in a desired direction (i.e., the combined electro-magnetic wave generated by the output signals is reinforced in a desired direction and suppressed in undesired directions, whereby the beam is emitted in the desired direction).

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in phase shifters, phase shifter apparatus and phased array systems. The following description is presented to enable one of ordinary skill in the art to make and use the invention as provided in the context of a particular application and its requirements. As used herein, directional terms such as "upper", "upward", "uppermost", "lower", "lowermost", "front", "rightmost" and "leftmost", are intended to provide relative positions for purposes of description, and are not intended to designate an absolute frame of reference. In addition, the phrases "integrally formed" and "integrally connected" are used herein to describe the connective relationship between two portions of a single fabricated or machined structure, and are distinguished from the terms "connected" or "coupled" (without the modifier "integrally"), which indicates two separate structures that are joined by way of, for example, adhesive, fastener, clip, or movable joint. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
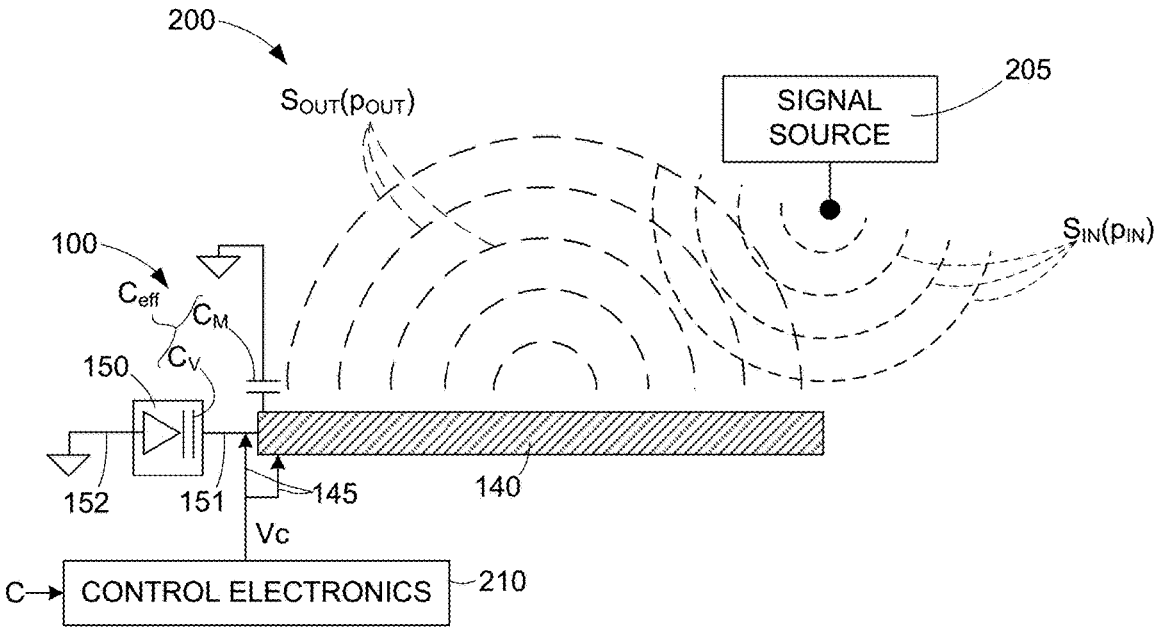
FIG. 1 is a simplified side view showing a phase shifting apparatus according to a generalized embodiment of the present invention.

FIG. 1 is a simplified side view showing a phase shifting apparatus 200 including at least one metamaterial-based phase shifting element 100 according to a generalized exemplary embodiment of the present invention. Phase shifting element 100 utilizes a metamaterial structure 140 to produce an output signal SOUT having the same radio wave frequency as that of an applied/received input signal SIN, and utilizes a variable capacitor (e.g., a varicap) 150 to control a phase pOUT of output signal SOUT by way of an applied phase control signal (i.e., either an externally supplied digital signal C or a direct-current control voltage Vc). Phase shifting apparatus 200 also includes a signal source 205 (e.g., a feed horn or a leaky-wave feed) disposed in close proximity to phase shifting element 100 and configured to generate input signal SIN at a particular radio wave frequency (i.e., in the range of 3 kHz to 300 GHz) and an input phase pIN, where the radio wave frequency matches resonance characteristics of phase shifting element 100, and a control circuit 210 (e.g., a digital-to-analog converter (DAC) that is controlled by any of a field programmable gate array (FPGA), an application specific integrated circuit (ASIC, or a micro-processor) that is configured to generate phase control voltages Vc applied to varicap 150 at voltage levels determined in accordance with (e.g., directly or indirectly proportional to) a pre-programmed signal generation scheme or an externally supplied phase control signal C.

Metamaterial structure 140 is preferably a layered metal-dielectric composite architecture, but may be engineered in a different form, provided the resulting structure is configured to resonate at the radio frequency of applied input signal $S_{IN}$, and has a large phase swing near resonance such that metamaterial structure 140 generates output signal $S_{OUT}$ at the input signal frequency by retransmitting (i.e., reflecting/scattering) input signal $S_{IN}$. In providing this resonance, metamaterial structure 140 is produced with an inherent "fixed" capacitance $C_M$ and an associated inductance that collectively provide the desired resonance characteristics. As understood in the art, the term "metamaterial" identifies an artificially engineered structure formed by two or more materials and multiple elements that collectively generate desired electromagnetic properties, where metamaterial achieves the desired properties not from its composition, but from the exactingly-designed configuration (i.e., the precise shape, geometry, size, orientation and arrangement) of the structural elements formed by the materials. As used herein, the phrase "metamaterial structure" is intended to mean a dynamically reconfigurable/tunable metamaterial having radio frequency resonance and large phase swing properties suitable for the purpose set forth herein. The resulting structure affects radio frequency (electromagnetic radiation) waves in an unconventional manner, creating material properties which are unachievable with conventional materials. Metamaterial structures achieve their desired effects by incorporating structural elements of sub-wavelength sizes, i.e. features that are actually smaller than the radio frequency wavelength of the waves they affect. In the practical embodiments described below, metamaterial structure 140 is constructed using inexpensive metal film or PCB fabrication technology that is tailored by solving Maxwell's equations to resonate at the radio frequency of applied input signal $S_{IN}$, whereby the metamaterial structure 140 generates output signal $S_{OUT}$ at the input signal frequency by retransmitting (i.e., reflecting/scattering) the input signal $S_{IN}$.

Varicap 150 is connected between metamaterial structure 140 and ground (or other fixed direct-current (DC) voltage supply). As understood in the art, varicaps (also known as varicap diodes, varactor diodes, or variable capacitance diodes) are a type of diode designed to exploit the voltage-dependent capacitance of a reversed-biased p-n junction, and are typically implemented as two-terminal electronic devices configured to produce a capacitance that is intentionally and repeatedly changeable by way of an applied electronic control signal. In this case, varicap 150 is coupled to metamaterial structure 140 such that an effective capacitance $C_{eff}$ of metamaterial structure 140 is determined by a product of inherent capacitance $C_M$ and a variable capacitance $C_V$ supplied by varicap 150. The output phase of metamaterial structure 140 is determined in part by effective capacitance $C_{eff}$, so output phase $p_{OUT}$ of output signal $S_{OUT}$ is "tunable" (adjustably controllable) to a desired phase value by way of changing variable capacitance $C_V$, and this is achieved by way of changing the phase control signal (i.e., digital control signal C and/or DC bias voltage Vc) applied to varicap 150.

Figure 2:
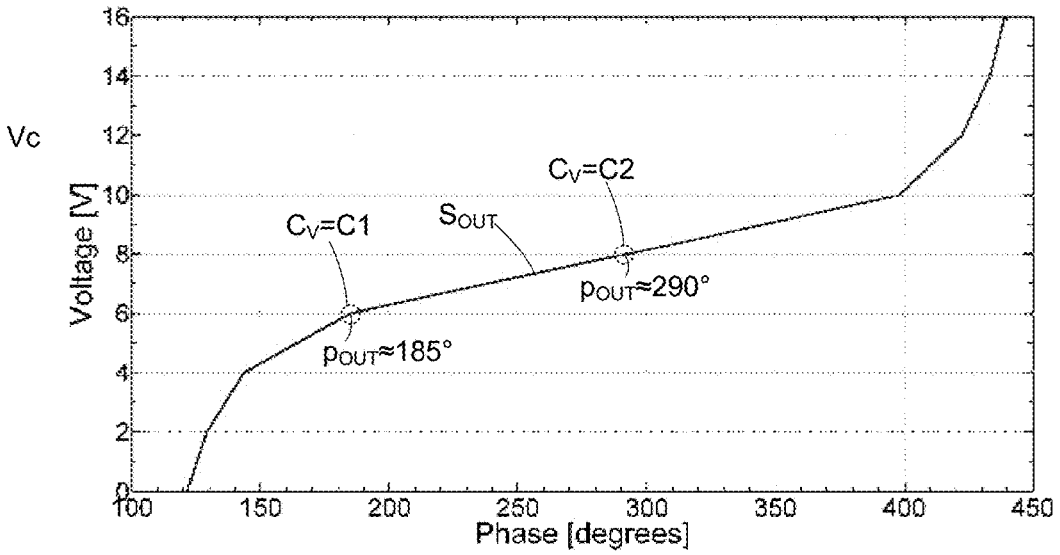
FIG. 2 is a diagram showing exemplary phase shifting characteristics associated with operation of the phase shifting apparatus of FIG. 1.

FIG. 2 is a diagram showing exemplary phase shifting characteristics associated with operation of phase shifting apparatus 200. In particular, FIG. 2 shows how output phase $p_{OUT}$ of output signal $S_{OUT}$ changes in relation to phase control voltage Vc. Because output phase $p_{OUT}$ varies in accordance with effective capacitance $C_{eff}$ of metamaterial structure 140 which in turn varies in accordance with variable capacitance $C_V$ generated by varicap 150 on metamaterial structure 140 (shown in FIG. 1), FIG. 2 also effectively depicts operating characteristics of varicap 150 (i.e., FIG. 2 effectively illustrates that variable capacitance $C_V$ varies in accordance with phase control voltage Vc by way of showing how output phase $p_{OUT}$ varies in accordance with phase control voltage Vc). For example, when phase control voltage Vc has a voltage level of 6V, varicap 150 generates variable capacitance $C_V$ at a corresponding capacitance level (indicated as "$C_V$=C1") and metamaterial structure 140 generates output signal $S_{OUT}$ at an associated output phase $p_{OUT}$ of approximately 185°. When phase control voltage Vc is subsequently increased from 6V to a second voltage level (e.g., 8V), varicap 150 generates variable capacitance at a second capacitance level (indicated as "$C_V$=C2") such that metamaterial structure 140 generates output signal $S_{OUT}$ at an associated second output phase $p_{OUT}$ of approximately 290°.

Referring again to FIG. 1, phase control voltage Vc is applied across varicap 150 by way of a conductive structure 145 that is connected either to metamaterial structure 140 or directly to a terminal of varicap 150. Specifically, varicap 150 includes a first terminal 151 connected to metamaterial structure 140 and a second terminal 152 connected to ground. As indicated in FIG. 1, conductive structure 145 is either connected to metamaterial structure 140 or to first terminal 151 of varicap 150 such that, when phase control voltage Vc is applied to conductive structure 145, varicap 150 generates an associated variable capacitance $C_V$ having a capacitance level that varies in accordance with the voltage level of phase control voltage Vc in the manner illustrated in FIG. 2 (e.g., the capacitance level of variable capacitance $C_V$ changes in direct proportion to phase control voltage Vc).

As set forth in the preceding exemplary embodiment, a novel aspect of the present invention is a phase shifting methodology involving control over radio wave output signal phase $p_{OUT}$ by selectively adjusting effective capacitance $C_{eff}$ of metamaterial structure 140, which is implemented in the exemplary embodiment by way of controlling varicap 150 using phase control voltage Vc to generate and apply variable capacitance $C_V$ onto metamaterial structure 140. Although the use of varicap 150 represents the presently preferred embodiment for generating variable capacitance $C_V$, those skilled in the art will recognize that other circuits may be utilized to generate a variable capacitance that controls effective capacitance $C_{eff}$ of metamaterial structure 140 in a manner similar to that described herein. Accordingly, the novel methodology is alternatively described as including: causing metamaterial structure 140 to resonate at the radio wave frequency of input signal $S_{IN}$; applying a variable capacitance $C_V$ (i.e., from any suitable variable capacitance source circuit) to metamaterial structure 140 such that effective capacitance $C_{eff}$ of metamaterial structure 140 is altered by variable capacitance $C_V$; and adjusting variable capacitance $C_V$ (i.e., by way of controlling the suitable variable capacitance source circuit) until effective capacitance $C_{eff}$ of metamaterial structure 140 has a capacitance value that causes metamaterial structure 140 to generate radio frequency output signal $S_{OUT}$ with output phase $p_{OUT}$ set at a desired phase value (e.g., 290°).

Figure 3A:
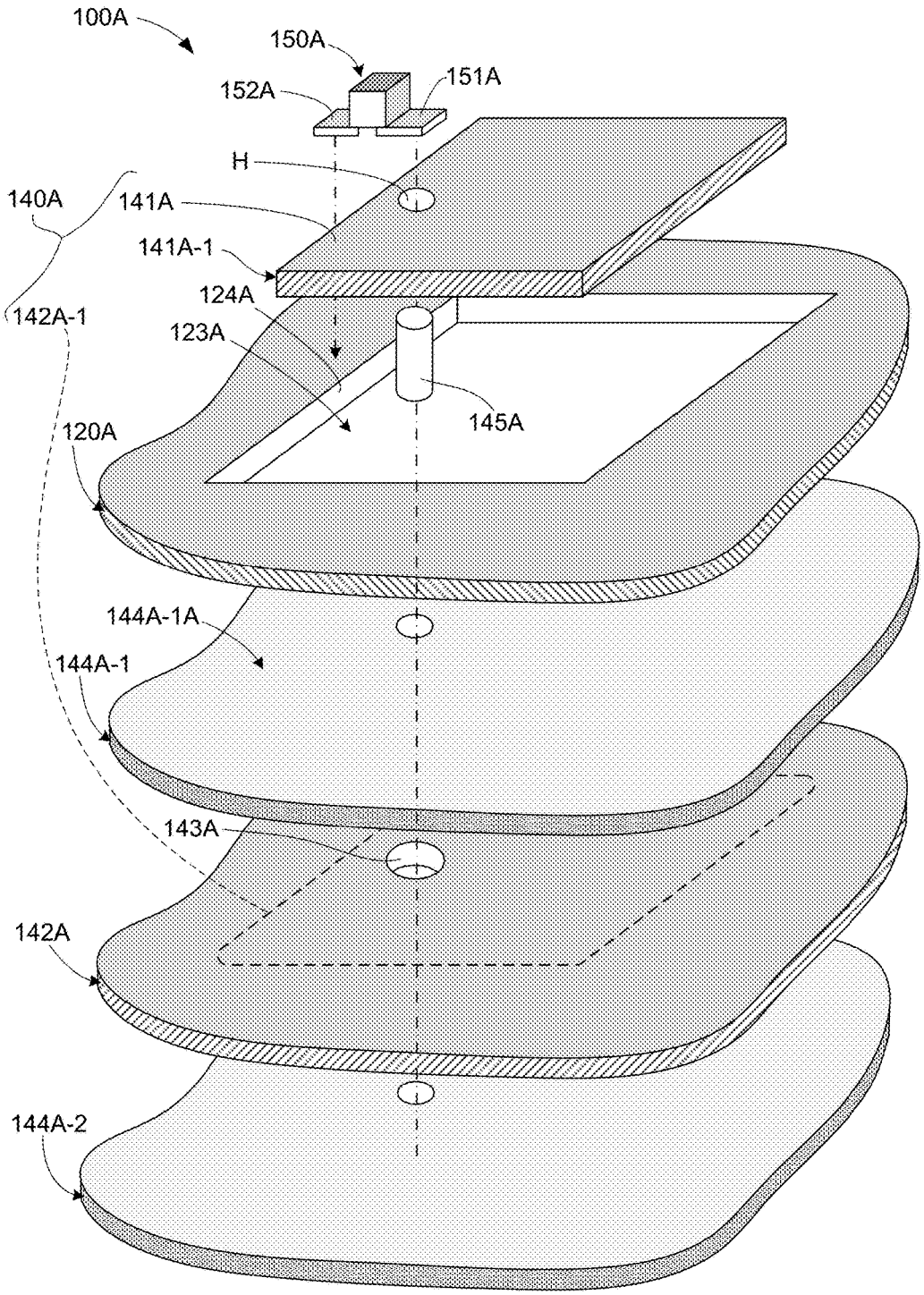
FIGS. 3(A) and 3(B) are exploded perspective and assembled perspective views, respectively, showing a phase shifting element according to an exemplary embodiment of the present invention.
Figure 3B:
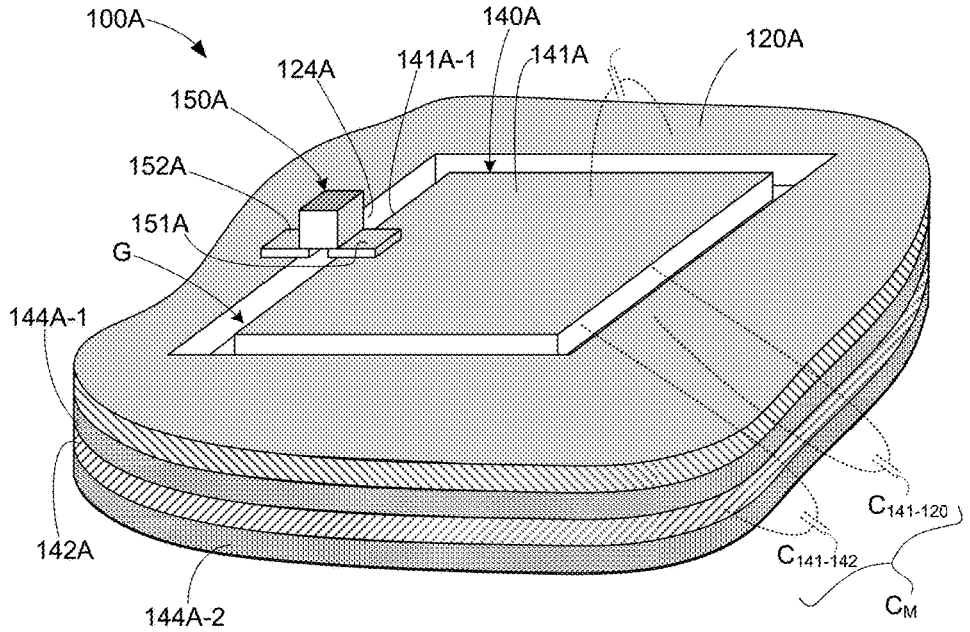
Figure 4:
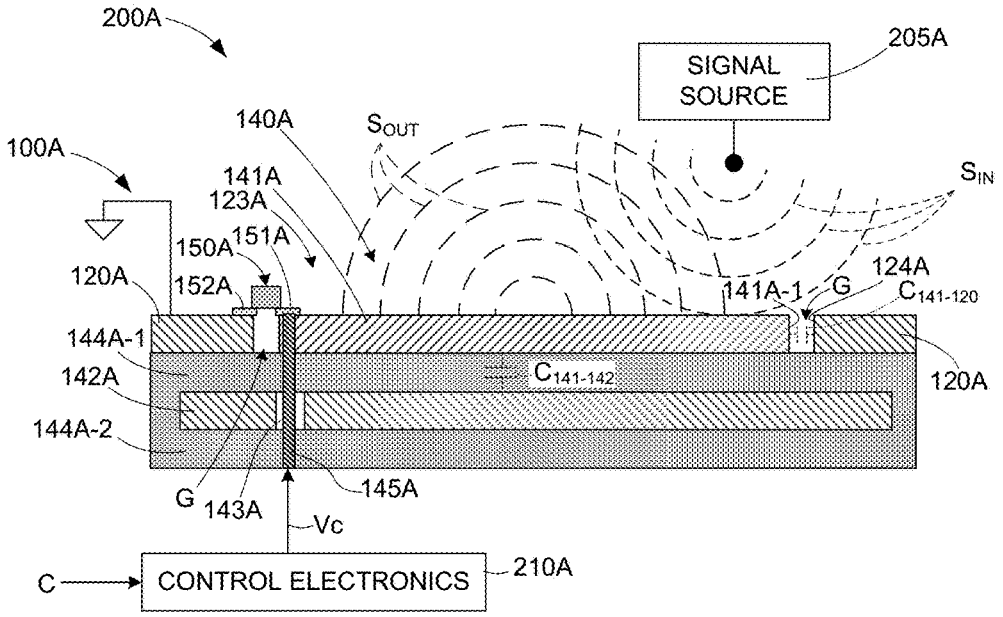
FIG. 4 is a cross-sectional side view showing a phase shifting apparatus including the phase shifting element of FIG. 3(B) according to another exemplary embodiment of the present invention.

As mentioned above, a presently preferred embodiment of the present invention involves the use of layered metamaterial structures. FIGS. 3(A) and 3(B) are exploded perspective and assembled perspective views, respectively, showing a phase shifting element 100A including a two-terminal varicap (variable capacitor) 150A and a metamaterial structure 140A having an exemplary three-level embodiment of the present invention, and FIG. 4 shows a phase shifting apparatus 200A including phase shifting element 100A in cross-sectional side view. Beneficial features and aspects of the three-layer structure used to form metamaterial structure 140A, and their usefulness in forming metamaterial-based phase shifting element 100A and apparatus 200A, are described below with reference to FIGS. 3(A), 3(B) and 4.

Referring to FIGS. 3(A) and 3(B), three-layer metamaterial structure 140A is formed by an upper/first metal layer (island) structure 141A, an electrically isolated (i.e., floating) backplane (lower/second metal) layer structure 142A, and a dielectric layer 144A-1 sandwiched between upper island structure 141A and backplane layer 142A, where island structure 141A and backplane layer 142A are cooperatively tailored (e.g., sized, shaped and spaced by way of dielectric layer 144A-1) such that the composite three-layer structure of metamaterial structure 140A has an inherent (fixed) capacitance $C_M$ that is at least partially formed by capacitance $C_{141\text{-}142}$ (i.e., the capacitance between island structure 141A and backplane layer 142A), and such that metamaterial structure 140A resonates at a predetermined radio wave frequency (e.g., 2.4 GHz). As discussed above, an effective capacitance of metamaterial structure 140A is generated as a combination of fixed capacitance $C_M$ and an applied variable capacitance, which in this case is applied to island structure 141A by way of varicap 150A. In this arrangement, island structure 141A acts as a wavefront reshaper, which ensures that the output signal $S_{OUT}$ is directed upward direction highly-directional in the upward direction only (i.e., such that the radio frequency output signal is emitted from island structure 141A in a direction away from backplane layer 142A), and which minimizes power consumption because of efficient scattering with phase shift.

According to a presently preferred embodiment, dielectric layer 144A-1 comprises a lossless dielectric material selected from the group including RT/Duroid® 6202 Laminates, Polytetrafluoroethylene (PTFE), and TMM4® dielectric, all produced by Rogers Corporation of Rogers, Conn. The use of such lossless dielectric materials mitigates absorption of incident radiation (e.g., input signal $S_{IN}$), and ensures that most of the incident radiation energy is re-emitted in output signal $S_{OUT}$. An optional lower dielectric layer 144A-2 is provided to further isolate backplane layer 142A, and to facilitate the backside mounting of control circuits in the manner described below.

According to another feature, both island (first metal layer) structure 141A and a base (third) metal layer structure 120A are disposed on an upper surface 144A-1A of dielectric layer 141A-1, where base metal structure 120A is spaced from (i.e., electrically separated by way of a gap G) island structure 141A. Metal layer structure 120A is connected to a ground potential during operation, base, whereby base layer structure 120A facilitates low-cost mounting of varicap 150A during manufacturing. For example, using pick-and-place techniques, varicap 150A is mounted such that first terminal 151A is connected (e.g., by way of solder or solderless connection techniques) to island structure 141A, and such that second terminal 152A is similarly connected to base metal structure 120A.

According to a presently preferred embodiment, base metal structure 120A comprises a metal film or PCB fabrication layer that entirely covers upper dielectric surface 144A-1A except for the region defined by an opening 123A, which is disposed inside an inner peripheral edge 124A, where island structure 141A is disposed inside opening 123A such that an outer peripheral edge 141A-1 of is structure 141A is separated from inner peripheral edge 124A by peripheral gap G, which has a fixed gap distance around the entire periphery. By providing base metal structure 120A such that it substantially covers all portions of upper dielectric surface 144A-1A not occupied by island structure 141A, base metal layer 120A forms a scattering surface that supports collective mode oscillations, and ensures scattering of the wave in the forward direction. In addition, island structure 141A, backplane layer 142A and base metal structure 120A are cooperatively configured (i.e., sized, shaped and spaced) such that inherent (fixed) capacitance $C_M$ includes both the island-backplane component $C_{141\text{-}142}$ and an island-base component $C_{141\text{-}120}$, and such that metamaterial structure 140A resonates at the desired radio wave frequency. In this way, base metal layer 120A provides the further purpose of effectively forming part of metamaterial structure 140A by enhancing fixed capacitance $C_M$.

According to another feature, both base (third) metal layer structure 120A and island (first metal layer) structure 141A comprise a single metal (i.e., both base metal structure 120A and island structure 141A comprise the same, identical metal composition, e.g., copper). This single-metal feature facilitates the use of low-cost manufacturing techniques in which a single metal film or PCB fabrication is deposited on upper dielectric layer 144A-1A, and then etched to define peripheral gap G. In other embodiments, different metals may be patterned to form the different structures.

According to another feature shown in FIG. 3(A), a metal via structure 145A is formed using conventional techniques such that it extends through lower dielectric layer 144A-2, through an opening 143A defined in backplane layer 142A, through upper dielectric layer 144A-1, and through an optional hole H formed in island structure 141A to contact first terminal 151A of varicap 150A. This via structure approach facilitates applying phase control voltages to varicap 150A without significantly affecting the electrical characteristics of metamaterial structure 140A. As set forth below, this approach also simplifies the task of distributing multiple control signals to multiple metamaterial structures forming a phased array.

FIG. 4 is a cross-sectional side view showing a phase shifting apparatus 200A generating output signal $S_{OUT}$ at an output phase $p_{OUT}$ determined an externally-supplied phase control signal C. Apparatus 200A includes a signal source 205A, phase shifting element 100A, and a control circuit 210A. Signal source 205A includes a suitable signal generator (e.g., a feed horn) that generates an input signal $S_{IN}$ at a specific radio wave frequency (e.g., 2.4 GHz), and is positioned such that input signal $S_{IN}$ is directed onto phase shifting element 100A, which is constructed as described above to resonate at the specific radio wave frequency (e.g., 2.4 GHz) such that it generates an output signal $S_{OUT}$. Control circuit 210A is configured to generate a phase control voltage Vc in response to phase control signal C such that phase control voltage Vc changes in response to changes in phase control signal C. Phase control voltage Vc is transmitted to varicap 150A, causing varicap 150A to generate and apply a corresponding variable capacitance onto island structure 141A, whereby metamaterial structure 140A is caused to generate output signal $S_{OUT}$ at an output phase $p_{OUT}$ determined by phase control signal C. Note that control circuit 210A is mounted on lower dielectric layer 144A-2 (i.e., below backplane layer 142A), and phase control voltage Vc is transmitted by way of conductive via structure via 145A to terminal 151A of varicap 150A.

Those skilled in the art understand that the metamaterial structures generally described herein can take many forms and shapes, provided the resulting structure resonates at a required radio wave frequency, and has a large phase swing near resonance. The embodiment shown in FIGS. 3(A), 3(B) and 4 utilizes a simplified square-shaped metamaterial structure and a solid island structure 141A to illustrate basic concepts of present invention. Specifically, metamaterial structure 140A is formed such that inner peripheral edge 124A surrounding opening 123A in base metal structure 120A and outer peripheral edge 141A-1 of island structure 141A comprise concentric square shapes such that a width of peripheral gap G remains substantially constant around the entire perimeter of island structure 141A. An advantage of using such square-shaped structures is that this approach simplifies the geometric construction and provides limited degrees of freedom that simplify the mathematics needed to correlate phase control voltage Vc with desired capacitance change and associated phase shift. In alternative embodiments, metamaterial structures are formed using shapes other than squares (e.g., round, triangular, rectangular/oblong).

Figure 5:
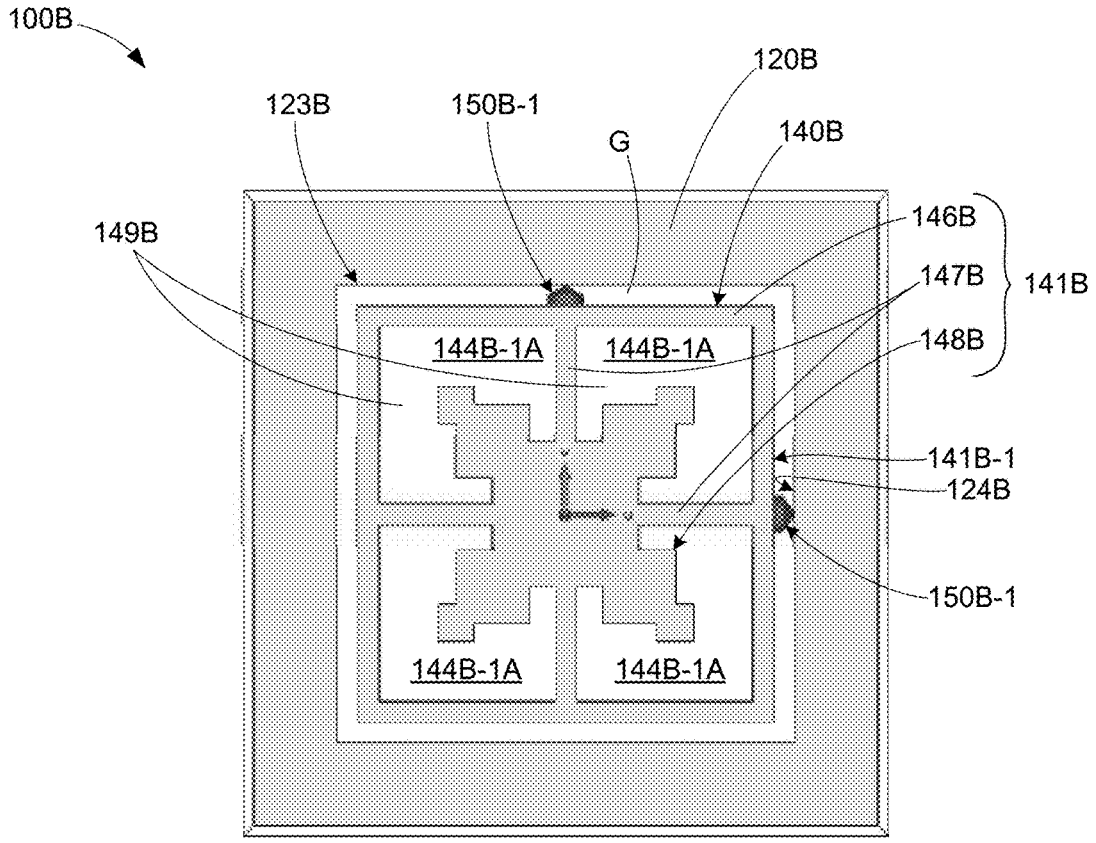
FIG. 5 is a perspective view showing a phase shifting element including an exemplary patterned metamaterial structure according to another embodiment of the present invention.

FIG. 5 is a perspective view showing a phase shifting element 100B including an exemplary patterned metamaterial structure 140B according to an exemplary specific embodiment of the present invention. In this embodiment, island structure 141B is formed as a patterned planar structure that defines open regions 149B (i.e., such that portions of upper dielectric surface 144B-1A are exposed through the open regions). In this example, island structure 141B includes a square-shaped peripheral frame portion 146B including an outer peripheral edge 141B-1 that is separated by a peripheral gap G from an inner peripheral edge 124B of base metal layer portion 120B, which is formed as described above, four radial arms 147B having outer ends integrally connected to peripheral frame portion 146B and extending inward from frame portion 146B, and an inner (in this case, "X-shaped") structure 148B that is connected to inner ends of radial arms 147B. Structure 148B extends into open regions 149B, which are formed between radial arms 147B and peripheral frame 146B. Metamaterial structure 140B is otherwise understood to be constructed using the three-layer approach described above with reference to FIGS. 3(A), 3(B) and 4. Although the use of patterned metamaterial structures may complicate the mathematics associated with correlating control voltage and phase shift values, the X-shaped pattern utilized by metamaterial structure 140B is presently believed to produce more degrees of freedom than is possible using solid island structures, leading to close to 360° phase swings, which in turn enables advanced functions such as beam steering at large angles (i.e., greater than plus or minus 60°). In addition, although metamaterial structure 140B is shown as having a square-shaped outer peripheral edge, patterned metamaterial structures having other peripheral shapes may also be beneficially utilized.

Figure 6:
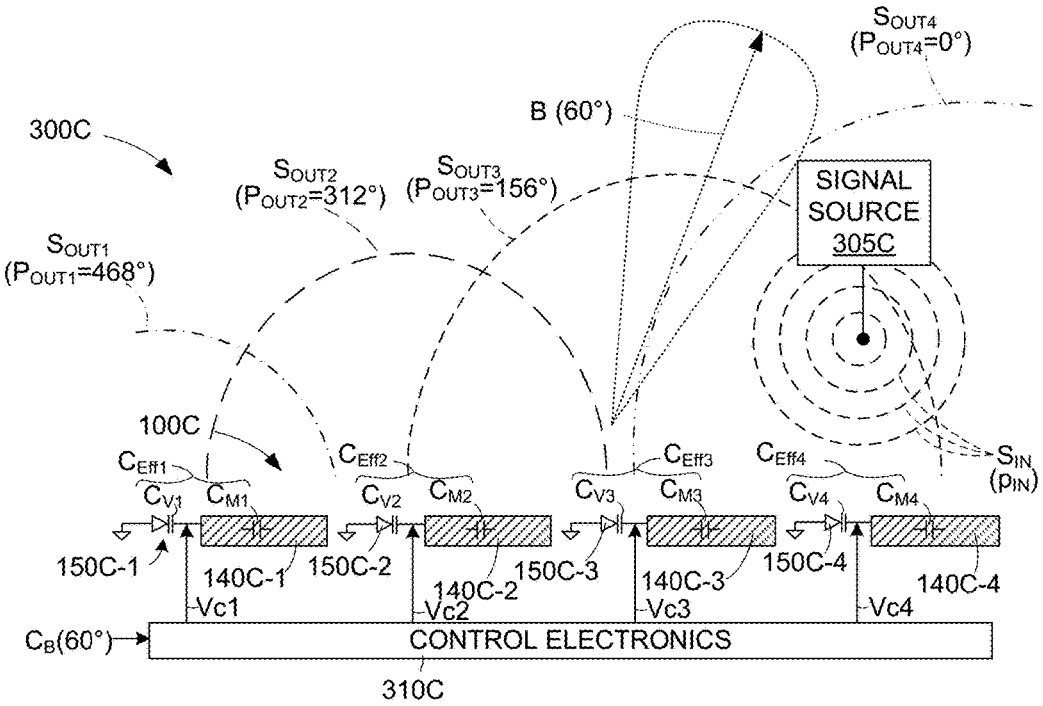
FIG. 6 is a cross-sectional side view showing a simplified phased array system including four phase shifting elements according to another exemplary embodiment of the present invention.

FIG. 6 is a cross-sectional side view showing a simplified metamaterial-based phased array system 300C for generating an emitted radio frequency energy beam B in accordance with another embodiment of the present invention. Phased array system 300C generally includes a signal source 305C, a phase shifting element array 100C, and a control circuit 310C. Signal source 305C is constructed and operates in the manner described above with reference to apparatus 200A to generate an input signal $S_{IN}$ having a specified radio wave frequency and an associated input phase $p_{IN}$.

According to an aspect of the present embodiment, phase shifting element array 100C includes multiple (in this case four) metamaterial structures 140C-1 to 140C-4 that are disposed in a predetermined coordinated pattern, where each of the metamaterial structures is configured in the manner described above to resonate at the radio wave frequency of input signal $S_{IN}$ in order to respectively produce output signals $S_{OUT1}$ to $S_{OUT4}$. For example, metamaterial structure 140C-1 fixed capacitance $C_{M1}$ and is otherwise configured to resonate at the radio wave frequency of input signal $S_{IN}$ in order to produce output signal $S_{OUT1}$. Similarly, metamaterial structure 140C-2 has fixed capacitance $C_{M2}$, metamaterial structure 140C-3 has fixed capacitance $C_{M3}$, and metamaterial structure 140C-4 has fixed capacitance $C_{M4}$, where metamaterial structures 140C-2 to 140C-4 are also otherwise configured to resonate at the radio wave frequency of input signal $S_{IN}$ to produce output signals $S_{OUT2}$, $S_{OUT3}$ and $S_{OUT4}$, respectively. The coordinated pattern formed by metamaterial structures 140C-1 to 140C-4 is selected such that output signals $S_{OUT1}$ to $S_{OUT4}$ combine to produce an electro-magnetic wave. Although four metamaterial structures are utilized in the exemplary embodiment, this number is arbitrarily selected for illustrative purposes and brevity, and array 100C may be produced with any number of metamaterial structures.

Similar to the single element embodiments described above, phase shifting element array 100C also includes varicaps 150C-1 to 150C-4 that are coupled to associated metamaterial structures 140C-1 to 140C-4 such that effective capacitances $C_{eff1}$ to $C_{eff4}$ of metamaterial structures 140C-1 to 140C-4 are respectively altered corresponding changes in variable capacitances $C_{V1}$ to $C_{V4}$, which in turn are generated in accordance with associated applied phase control voltages Vc1 to Vc4. For example, varicap 150C-1 is coupled to metamaterial structure 140C-1 such that effective capacitance $C_{eff1}$ is altered by changes in variable capacitance $C_{V1}$, which in turn changes in accordance with applied phase control voltage Vc1.

According to another aspect of the present embodiment, control circuit 310C is configured to independently control the respective output phases $p_{OUT1}$ to $p_{OUT4}$ of output signals $S_{OUT1}$ to $S_{OUT4}$ using a predetermined set of variable capacitances $C_{V1}$ to $C_{V4}$ that are respectively applied to metamaterial structures 140C-1 to 140C-4 such that output signals $S_{OUT1}$ to $S_{OUT4}$ cumulatively generate emitted beam B in a desired direction. That is, as understood by those skilled in the art, by generating output signals $S_{OUT1}$ to $S_{OUT4}$ with a particular coordinated set of output phases $p_{OUT1}$ to $p_{OUT4}$, the resulting combined electro-magnetic wave produced by phase shifting element array 100C is reinforced in the desired direction and suppressed in undesired directions, thereby producing beam B emitted in the desired direction from the front of array 100C). By predetermining a combination (set) of output phases $p_{OUT1}$ to $p_{OUT4}$ needed to produce beam B in a particular direction, and by predetermining an associated combination of phase control voltages Vc1 to Vc4 needed to produce this combination of output phases $p_{OUT1}$ to $p_{OUT4}$, and by constructing control circuit 310C such that the associated combination of phase control voltages Vc1 to Vc4 are generated in response to a beam control signal $C_B$ having a signal value equal to the desired beam direction, the present invention facilitates the selective generation of radio frequency beam that are directed in a desired direction. For example, as depicted in FIG. 6, in response to a beam control signal $C_B$ having a signal value equal to a desired beam direction of 60°, control circuit 310C generates an associated combination of phase control voltages Vc1 to Vc4 that cause metamaterial structures 140C-1 to 140C-4 to generate output signals $S_{OUT1}$ to $S_{OUT4}$ at output phases $p_{OUT1}$ to $p_{OUT4}$ of 4680, 3120, 156° and 0°, respectively, whereby output signals $S_{OUT1}$ to $S_{OUT4}$ cumulatively produce emitted beam B at the desired 60° angle.

Figure 7:
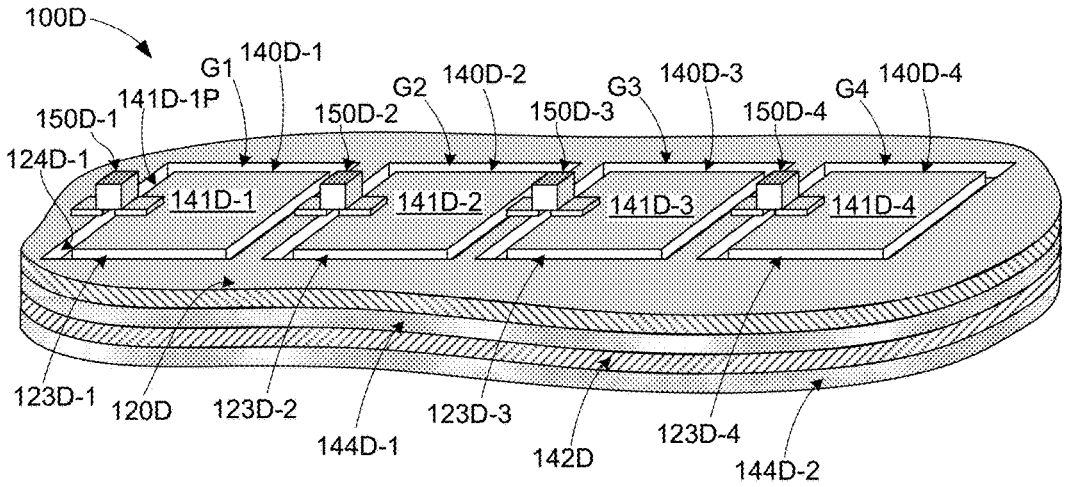
FIG. 7 is a simplified perspective view showing a phase shifting element array according to another exemplary embodiment of the present invention.

FIG. 7 is a simplified perspective and cross-sectional view showing a phase shifting element array 100D in which metamaterial structures 140D-1 to 140D-4 are formed using the three-layered structure described above with reference to FIGS. 3(A) and 3(B), and arranged in a one-dimensional array and operably coupled to varicaps 150D-1 to 150D-4, respectively. Similar to the single element embodiment described above, phase shifting element array 100D includes an electrically isolated (floating) metal backplane layer 142D, and (lossless) dielectric layers 144D-1 and 144D-2 disposed above and below backplane layer 142D.

As indicated in FIG. 7, each metamaterial structure (e.g., structure 140D-1) includes a metal island structure 141D-1 disposed on upper dielectric layer 144D-1 and effectively includes an associated backplane layer portion 142D-1 of backplane layer 142D disposed under metal island structure 141D-1 with an associated portion of the dielectric layer 144A-1 sandwiched therebetween). For example, metamaterial structure 140D-1 includes island structure 141D-1, backplane layer portion 142D-1, and an associated portion of upper dielectric layer 144A-1 that is sandwiched therebetween. Similarly, metamaterial structure 140D-2 includes island structure 141D-2 and backplane layer portion 142D-2, metamaterial structure 140D-3 includes island structure 141D-3 and backplane layer portion 142D-3, and metamaterial structure 140D-4 includes island structure 141D-4 and backplane layer portion 142D-4. Consistent with the single element description provided above, each associated metal island structure and backplane layer portion are cooperatively configured (e.g., sized and spaced) such that each metamaterial structure resonates at a specified radio frequency. For example, metal island structure 141D-1 and backplane layer portion 142D-1 are cooperatively configured to produce a fixed capacitance that causes metamaterial structure 140D-1 to resonate at a specified radio frequency.

Figure 8:
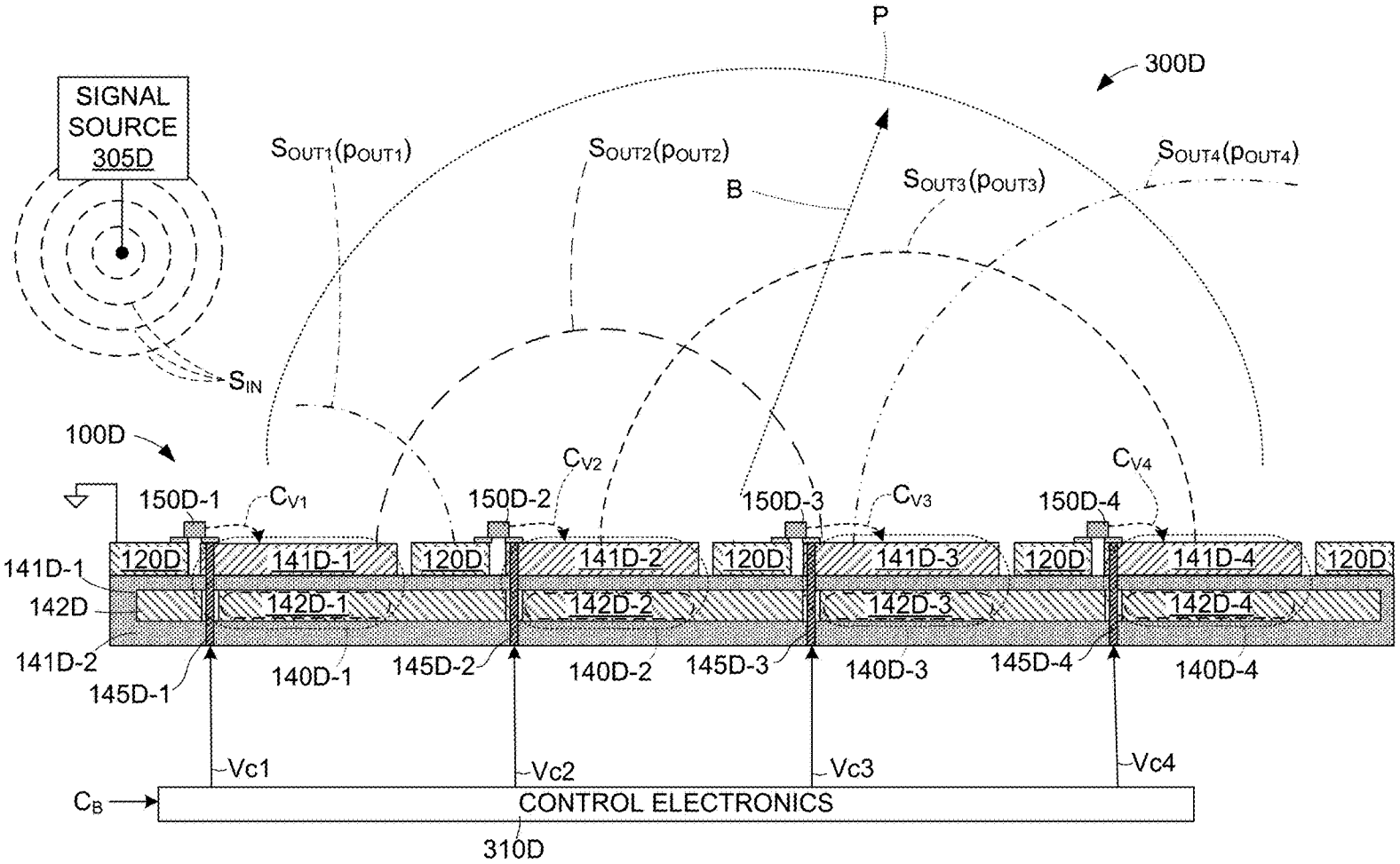
FIG. 8 is a simplified diagram depicting a phased array system including the phase shifting element array of FIG. 7 according to another embodiment of the present invention.

As indicated in FIG. 8, phase shifting element array 100D further includes a base metal structure 120D disposed on upper dielectric layer 141D-1 that is spaced (i.e., electrically isolated) from each of metal island structures 141D-1 to 141D-4 in a manner similar to the single element embodiment described above. In this case, base metal structure 120D defines four openings 123D-1 to 123D-4, each having an associated inner peripheral edge that is separated from an outer peripheral edge of associated metal island structures 141D-1 to 141D-4 by way of peripheral gaps G1 to G4 (e.g., island structures 141D-1 is disposed in opening 123D-1 and is separated from base metal structure 120D by gap G1). Varicaps 150D-1 to 150D-4 respectively extend across gaps G1 to G4, and have one terminal connected to an associated metal island structure 141D-1 to 141D-4, and a second terminal connected to base metal structure 120D (e.g., varicap 150D-1 extends across gap G1 between metal island structure 141D-1 and base metal structure 120D). Base metal structure 120D and metal island structures 141D-1 to 141D-4 are preferably formed by etching a single metal layer (i.e., both comprise the same metal composition, e.g., copper).

FIG. 8 also shows phase shifting element array 100D incorporated into a phased array system 300D that includes a signal source 305D and a control circuit 310D. Signal source 305D is configured to operate in the manner described above to generate input signal $S_{IN}$ having the resonance radio frequency of metamaterial structures 140D-1 to 140D-4. Control circuit 310D is configured to generate phase control voltages Vc1 to Vc4 that are transmitted to varicaps 150D-1 to 150D-4, respectively, by way of metal via structures 145D-1 to 145D-4 in the manner described above, whereby varicaps 150D-1 to 150D-4 are controlled to apply associated variable capacitances $C_{V1}$ to $C_{V4}$ onto metal island structures 141D-1 to 141D-4, respectively. According to an aspect of the present embodiment, because metamaterial structures 140D-1 to 140D-4 are aligned in a one-dimensional array (i.e., in a straight line), variations in output phases $p_{OUT1}$ to $p_{OUT4}$ cause resulting beam B to change direction in a planar region (i.e., in the phase shaped, two-dimensional plane P, which is shown in FIG. 8).

Figure 9:
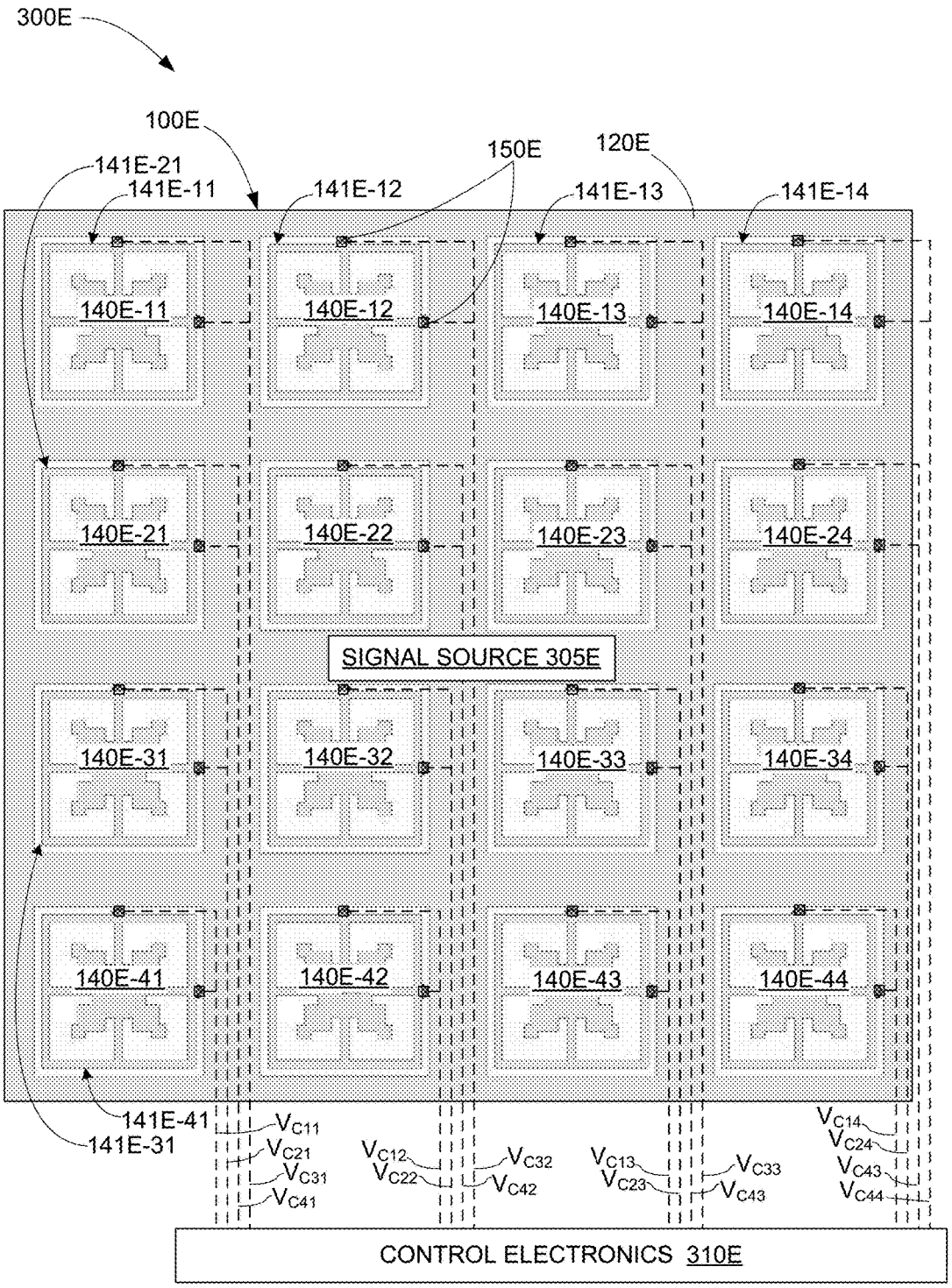
FIG. 9 is simplified diagram showing a phased array system including metamaterial structures disposed in a two-dimensional pattern according to another exemplary embodiment of the present invention.

FIG. 9 is simplified top view showing a phased array system 300E including a phase shifting element array 100E having sixteen metamaterial structures 140E-11 to 140E-44 surrounded by a base metal structure 120E, a centrally located signal source 305E, and a control circuit 310E (which is indicated in block form for illustrative purposes, but is otherwise disposed below metamaterial structures 140E-11 to 140E-44).

According to an aspect of the present embodiment, metamaterial structures 140E-11 to 140E-44 are disposed in a two-dimensional pattern of rows and columns, and each metamaterial structure 140E-11 to 140E-44 is individually controllable by way of control voltages $V_{C11}$ to $V_{C44}$, which are generated by control circuit 310E and transmitted by way of conductive structures (depicted by dashed lines) in a manner similar to that described above. Specifically, uppermost metamaterial structures 140E-11, 140E-12, 140E-13 and 140E-14 form an upper row, with metamaterial structures 140E-21 to 140E-24 forming a second row, metamaterial structures 140E-31 to 140E-34 forming a third row, and metamaterial structures 140E-41 to 140E-44 forming a lower row. Similarly, leftmost metamaterial structures 140E-11, 140E-21, 140E-31 and 140E-41 form a leftmost column controlled by control voltages $V_{C11}$, $V_{C21}$, $V_{C31}$ and $V_{C41}$, respectively, with metamaterial structures 140E-12 to 140E-42 forming a second column controlled by control voltages $V_{C12}$ to $V_{C42}$, metamaterial structures 140E-13 to 140E-43 forming a third column controlled by control voltages $V_{C13}$ to $V_{C43}$, and metamaterial structures 140E-14 to 140E-44 forming a fourth (rightmost) column controlled by control voltages $V_{C14}$ to $V_{C44}$.

According to an aspect of the present embodiment, two varicaps 150E are connected between each metamaterial structure 140E-11 to 140E-44 and base metal structure 120E. The configuration and purpose of varicaps 150E is the same as that provided above, where utilizing two variable capacitors increases the range of variable capacitance applied to each metamaterial structure. In the illustrated embodiment, a single control voltage is supplied to both variable capacitors of each metamaterial structure, but in an alternative embodiment individual control voltages are supplied to each of the two variable capacitors of each metamaterial structure. In addition, a larger number of variable capacitors may be used.

Figure 10A:
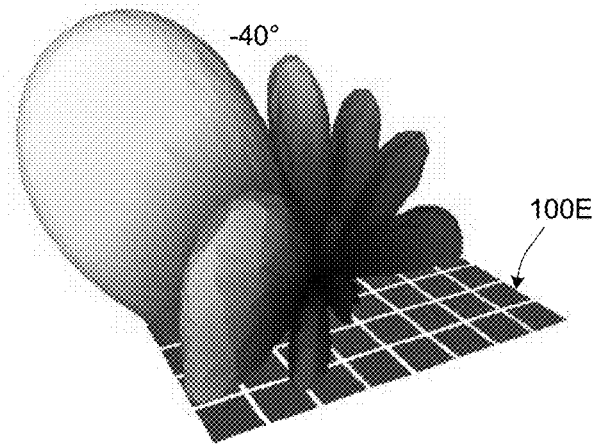
FIGS. 10(A), 10(B) and 10(C) are diagrams depicting emitted beams generated in various exemplary directions by the phased array system of FIG. 9.
Figure 10B:
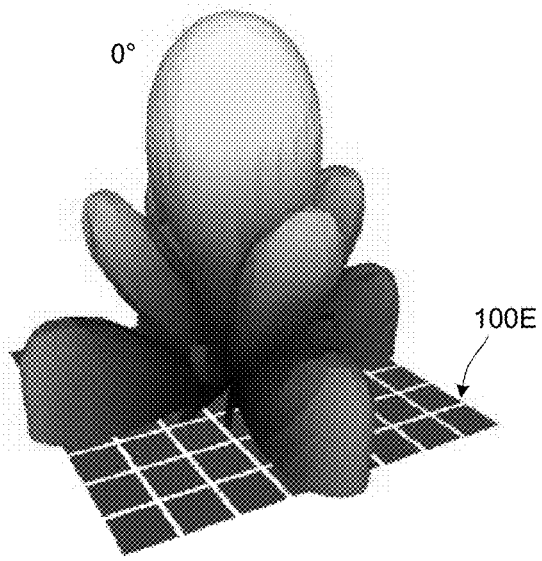
Figure 10C:
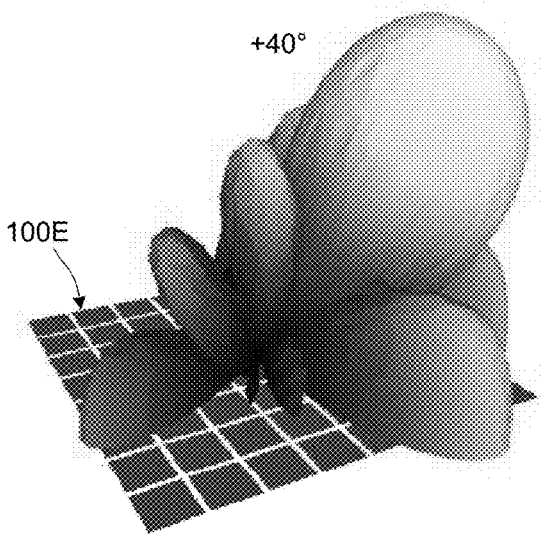

Control circuit 310E is configured to generate phase control voltages $V_{c11}$ to $V_{c44}$ that are transmitted to varicaps 150E of each metamaterial structure 140E-11 to 140E-44, respectively, such that varicaps 150E are controlled to apply associated variable capacitances to generate associated output signals having individually controlled output phases. According to an aspect of the present embodiment, because metamaterial structures 140E-11 to 140E-44 are arranged in a two-dimensional array (i.e., in rows and columns), variations in output phases cause resulting beams to change direction in an area defined by a three-dimensional region, shown in FIGS. 10(A) to 10(C). Specifically, FIGS. 10(A), 10(B) and 10(C) are diagrams depicting the radiation pattern at 0, +40 and −40 degrees beam steer. The radiation pattern consists of a main lobe and side lobes. The side lobes represent unwanted radiation in undesired directions.

Although the present invention has been described with respect to certain specific embodiments, it will be clear to those skilled in the art that the inventive features of the present invention are applicable to other embodiments as well, all of which are intended to fall within the scope of the present invention.

The invention claimed is:

1. A phase shifting element configured to receive an electromagnetic radiation input signal having a radio wave frequency and an input phase, and configured to generate an electromagnetic radiation output signal having said radio wave frequency and having an output phase determined by an applied phase control signal, the phase shifting element comprising:

a three-layer structure including:

an upper patterned metamaterial structure configured to have a fixed capacitance, and configured such that said metamaterial structure resonates at said radio wave frequency in response to said input signal, a backplane layer that is electrically isolated from the upper patterned metamaterial structure, and a dielectric layer disposed between and coupled to the upper patterned metamaterial structure and the backplane layer; and a varicap configured to generate a variable capacitance that varies in accordance with said applied phase control signal, said varicap including a first terminal coupled to said metamaterial structure and a second terminal coupled to a fixed potential such that an effective capacitance of said metamaterial structure is altered by a corresponding change in said variable capacitance, whereby said metamaterial structure generates said output signal at said output phase determined by said applied phase control signal.

2. The phase shifting element of claim 1, wherein said phase control signal comprises a direct-current phase control voltage, and wherein the varicap is configured such that:

when said phase control voltage is applied across said varicap and has a first voltage level, said varicap generates said variable capacitance at a first capacitance level such that said metamaterial structure generates said output signal at an associated first output phase, and when said applied phase control voltage is increased from said first voltage level to a second voltage level, said varicap generates said variable capacitance at a second capacitance level such that said metamaterial structure generates said output signal at an associated second output phase, said second output phase being greater than said first output phase.

3. A phase shifting element configured to receive an input signal having a radio wave frequency and an input phase, and configured to generate an output signal having said radio wave frequency and having an output phase determined by an applied phase control signal, the phase shifting element comprising:

a three-layer structure including:

an upper patterned metamaterial structure configured to have a fixed capacitance, and configured such that said metamaterial structure resonates at said radio wave frequency, a backplane layer that is electrically isolated from the upper patterned metamaterial structure, and a dielectric layer disposed between and coupled to the upper patterned metamaterial structure and the backplane layer; and a varicap configured to generate a variable capacitance that varies in accordance with said applied phase control signal, said varicap being coupled to said metamaterial structure such that an effective capacitance of said metamaterial structure is altered by a corresponding change in said variable capacitance, whereby said metamaterial structure generates said output signal at said output phase determined by said applied phase control signal, wherein said varicap includes a first terminal connected to said metamaterial structure and a second terminal connected to a fixed potential, wherein said phase shifting element further comprises a conductive structure connected to one of said metamaterial structure and said first terminal of said varicap such that, when said phase control signal is applied to said conductive structure and said second terminal is connected to a ground potential, said varicap generates said associated variable capacitance having a capacitance level that is proportional to said phase control signal.

4. A phase shifting element configured to receive an input signal having a radio wave frequency and an input phase, and configured to generate an output signal having said radio wave frequency and having an output phase determined by an applied phase control signal, the phase shifting element comprising:

a metamaterial structure configured to have a fixed capacitance, and configured such that said metamaterial structure resonates at said radio wave frequency; and a varicap configured to generate a variable capacitance that varies in accordance with said applied phase control signal, said varicap being coupled to said metamaterial structure such that an effective capacitance of said metamaterial structure is altered by a corresponding change in said variable capacitance, whereby said metamaterial structure generates said output signal at said output phase determined by said applied phase control signal, wherein said metamaterial structure comprises a three-layer structure including:

a first metal layer structure connected to said varicap;

an electrically isolated second metal layer structure; and a dielectric layer sandwiched between said first and second metal layer structures, wherein the varicap is mounted on said first metal layer such that said first metal layer is disposed between said varicap and said dielectric layer, and wherein said first and second metal layer structures are cooperatively configured such that said metamaterial structure resonates at said radio wave frequency and has said fixed capacitance.

5. The phase shifting element of claim 4, wherein said dielectric layer comprises a lossless dielectric material.

6. The phase shifting element of claim 4, wherein said first metal layer structure is disposed on an upper dielectric surface of said dielectric layer, wherein said phase shifting element further comprises a third metal layer structure disposed on said upper dielectric surface and spaced from said first metal layer structure, and wherein said varicap includes a first terminal connected to said first metal layer structure and a second terminal connected to said third metal structure.

7. The phase shifting element of claim 6, wherein said third metal layer structure defines an opening disposed inside an inner peripheral edge, wherein said first metal layer structure is disposed inside said opening such that an outer peripheral edge of said first metal layer structure is separated from the inner peripheral edge of said third metal layer structure by a peripheral gap, and wherein said first, second and third metal layer structures are cooperatively configured such that said metamaterial structure resonates at said radio wave frequency and has said fixed capacitance.

8. The phase shifting element of claim 7, wherein said third metal layer structure and said first metal layer structure comprise a single metal.

9. The phase shifting element of claim 7, further comprising a metal via structure extending through the dielectric layer and contacting the first terminal of said varicap.

10. The phase shifting element of claim 7, wherein said inner peripheral edge defining said at least one opening in said third metal layer structure and said outer peripheral edge of said first metal layer structure comprise concentric square shapes such that a width of said peripheral gap remains substantially constant around the entire perimeter of said first metal layer structure.

11. The phase shifting element of claim 4, wherein the first metal layer structure comprises a patterned planar structure defining one or more open regions.

12. The phase shifting element of claim 11, wherein the first metal layer structure comprises:

a peripheral frame portion including said outer peripheral edge;

one or more radial arms, each radial arm having a first end integrally connected to the peripheral frame portion and extending inward from the peripheral frame toward a central region of said metamaterial structure; and an inner structure integrally connected to second ends of the one or more radial arms, said inner structure being entirely surrounded by and spaced from said peripheral frame portion by way of said one or more open regions.

13. A phase shifting apparatus configured to generate an electromagnetic radiation output signal at an output phase determined by a phase control signal, said apparatus comprising:

a signal source configured to generate a first electromagnetic radiation signal having a radio wave frequency and a first phase;

a phase shifting element including:

a three-layer structure including an upper patterned metamaterial structure configured to have a fixed capacitance, and configured such that said metamaterial structure resonates at said radio wave frequency in response to said input signal, a backplane layer that is electrically isolated from the upper patterned metamaterial structure, and a dielectric layer disposed between and coupled to the upper patterned metamaterial structure and the backplane layer, and a varicap configured to generate a variable capacitance that varies in accordance with an applied phase control voltage, said varicap being disposed over said metamaterial structure such that said metamaterial structure is disposed between said varicap and said dielectric layer, wherein said varicap is coupled to said metamaterial structure such that an effective capacitance of said metamaterial structure is altered by a corresponding change in said variable capacitance; and a control circuit configured to generate said phase control voltage applied to said varicap at a voltage level determined in accordance with said phase control signal, whereby said metamaterial structure generates said output signal at said output phase determined by said phase control signal.

14. A phase shifting apparatus configured to generate an output signal at an output phase determined by a phase control signal, said apparatus comprising:

a signal source configured to generate a first electromagnetic radiation signal having a radio wave frequency and a first phase;

a phase shifting element including:

a metamaterial structure configured to have a fixed capacitance, and configured such that said metamaterial structure resonates at said radio wave frequency, and a varicap configured to generate a variable capacitance that varies in accordance with an applied phase control voltage, said varicap being coupled to said metamaterial structure such that an effective capacitance of said metamaterial structure is altered by a corresponding change in said variable capacitance; and a control circuit configured to generate said phase control voltage applied to said varicap at a voltage level determined in accordance with said phase control signal, whereby said metamaterial structure generates said output signal at said output phase determined by said phase control signal, wherein said metamaterial structure comprises a three-layer structure including:

a first metal layer structure connected to said varicap;

an electrically isolated second metal layer structure; and a dielectric layer sandwiched between said first and second metal layer structures, wherein said signal source and said varicap are disposed over the first metal layer structure such that said first metal layer structure is disposed between said signal source and said dielectric layer, and between said signal source and said varicap, and wherein said first and second metal layer structures are cooperatively configured such that said metamaterial structure resonates at said radio wave frequency and has said fixed capacitance.

15. The phase shifting apparatus of claim 14, wherein said first metal layer structure is disposed on an upper dielectric surface of said dielectric layer, wherein said phase shifting element further comprises a third metal layer structure disposed on said upper dielectric surface and spaced from said first metal layer structure, and wherein said varicap includes a first terminal connected to said first metal layer structure and a second terminal connected to said third metal structure.

16. The phase shifting apparatus of claim 15, wherein said third metal layer structure defines an opening disposed inside an inner peripheral edge, wherein said first metal layer structure is disposed inside said opening such that an outer peripheral edge of said first metal layer structure is separated from the inner peripheral edge of said third metal layer structure by a peripheral gap, and wherein said first, second and third metal layer structures are cooperatively configured such that said metamaterial structure resonates at said radio wave frequency and has said fixed capacitance.

17. The phase shifting apparatus of claim 16, wherein the control circuit is mounted below the electrically isolated second metal layer structure, and wherein the phase shifting apparatus further comprises a metal via structure extending from the control circuit through the dielectric layer and contacting the first terminal of the varicap.

18. A phased array system for generating an emitted beam, said phased array system comprising:

a signal source configured to generate a first electromagnetic radiation signal having a radio wave frequency and a first phase;

a phase shifting element array including:

a plurality of three-layer metamaterial structures, each said metamaterial structure including an upper patterned metal structure configured to have an associated fixed capacitance such that said each metamaterial structure resonates at said radio wave frequency in response to said input signal, a backplane layer that is electrically isolated from the upper patterned metamaterial structure, and a dielectric layer disposed between and coupled to the upper patterned metamaterial structure and the backplane layer, and a plurality of varicaps configured to respectively generate associated variable capacitances that vary in accordance with associated applied phase control voltages, each said varicap being a two-terminal electronic device coupled between a fixed potential and an associated said metamaterial structure such that an effective capacitance of said associated metamaterial structure is altered by a corresponding change in the variable capacitance generated by said each varicap in accordance with an associated applied phase control voltages; and a control circuit configured to generate a plurality of phase control voltages, each phase control voltage being applied to an associated varicap of said plurality of varicaps, said plurality of phase control voltages having a plurality of voltage levels such that said plurality of metamaterial structures respectively generate output signals at a plurality of different output phases, wherein said plurality of different output phases are respectively coordinated such that said output signals cumulatively generate said emitted beam.

19. The phased array system of claim 18, wherein said plurality of metamaterial structures are arranged in a one-dimensional array, whereby changes in said plurality of phase control voltages cause said beam to change direction in a region defined by a two-dimensional plane.

20. The phased array system of claim 18, wherein said plurality of metamaterial structures are arranged in a two-dimensional array such that said metamaterial structures are aligned in a plurality of rows and a plurality of columns, whereby changes in said plurality of phase control voltages cause said beam to change direction in an area defined by a three-dimensional region.

* * * * *